US006086517A

United States Patent [19]

Schapmire

[11] Patent Number: 6,086,517

[45] Date of Patent: Jul. 11, 2000

[54] APPARATUS AND METHOD FOR TESTING PUSHING AND PULLING CAPACITY AND EXERCISING A MUSCLE

[76] Inventor: Darrell William Schapmire, 128 Madison St., Hopedale, Ill. 61747

[21] Appl. No.: 09/360,437

[22] Filed: Jul. 26, 1999

[51] Int. Cl.[7] ..... A63B 22/20

[52] U.S. Cl. ..... 482/8; 482/68

[58] Field of Search ..... 482/4, 5, 6, 8, 482/9, 68, 66, 95, 96, 131, 132; 280/87.01, 87.02, 87.041; 473/445, 440, 441, 443

[56] References Cited

U.S. PATENT DOCUMENTS

| | | | |
|---|---|---|---|
| 3,465,592 | 9/1969 | Perrine . | |
| 3,501,142 | 3/1970 | Johansson . | |
| 4,337,050 | 6/1982 | Engalitcheff, Jr. . | |
| 4,451,037 | 5/1984 | O'Hare . | |
| 4,473,226 | 9/1984 | Browning et al. . | |
| 4,475,408 | 10/1984 | Browning . | |
| 4,844,459 | 7/1989 | Francis et al. | 473/445 |
| 4,890,495 | 1/1990 | Slane . | |
| 4,907,797 | 3/1990 | Walter et al. . | |
| 4,972,711 | 11/1990 | Sanjeev et al. . | |
| 5,142,910 | 9/1992 | Litchman . | |
| 5,275,045 | 1/1994 | Johnston et al. . | |
| 5,413,544 | 5/1995 | Fiore | 482/146 |

*Primary Examiner*—Glenn E. Richman

[57] ABSTRACT

A cart for rehabilitation exercise and testing dynamic pushing and pulling forces has a plurality of wheels, a handle, and a braking device attached to one or more pulleys. Said pulleys are affixed to an axle in static positions. Two or more bearingless wheels are affixed to said axle on which the pulleys are positioned in such a manner as to allow said wheels to turn in unison with the axle. A strap, which is suspended on one end from a housing, is held in contact with the perimeter of the pulley and is threaded through a slip buckle. Said slip buckle is connected to one end of a tension spring. The other end of said tension spring is suspended from said housing. Tension on the brake is regulated by adjusting the amount of said strap which is pulled through the slip buckle. The amount of force applied to the cart for rehabilitation exercise, or generated by a subject during a test, can be measured by using a manually-operated, commercially available, force gauge. Using a multiple test protocol, it is possible to analyze consistency of effort during a pushing and pulling assessment.

1 Claim, 4 Drawing Sheets

APPARATUS AND METHOD FOR TESTING PUSHING AND PULLING CAPACITY AND EXERCISING A MUSCLE

BACKGROUND OF THE INVENTION

1. Field of the Invention

This invention relates to dynamic pushing and pulling capacity testing devices, specifically to such manually-propelled vehicles which are used to assess consistency of effort during a pushing and pulling assessment and to such manually-propelled vehicles that are used to exercise a muscle. Various equipment and methodologies are currently used to evaluate validity of effort in subjects who have filed insurance claims for physical injury. In a therapeutic setting, various devices and methods are used to rehabilitate a muscle.

2. Description of the Prior Art

Work-related injuries represent a major source of financial loss each year for businesses and injured parties in this country. Significant claims for personal injury also arise from motor vehicle accidents and other accidents which are unrelated to the workplace. Together, the medical and indemnity expenses associated with these claims cost billions of dollars annually.

A disproportionate amount of money in compensable cases is spent on a relatively small number of the claims which are filed. In part, this occurs because some claimants may need to undergo surgery and/or extensive physical rehabilitation. In other cases, expenses related to treatment, rehabilitation and indemnity are inflated because individuals abuse a compensation system and receive treatment or monetary awards that are not justified.

Various physical tests are often performed on compensation claimants in order to determine the need for treatment, the necessity of return to work restrictions or to arrive at a financial settlement for a case. In such tests, it is essential that measures be incorporated in a test protocol to objectively identify performances that are not reflective of maximum efforts.

Not infrequently during an assessment of an individual's functional abilities, apparent inconsistencies in performance are noted. The classic example of such inconsistent behaviors may occur during a hand grip assessment in which a low back pain patient demonstrates physical weakness and wide variability between trials on a hand-held dynamometer. (Hand grip weakness can not be explained in the physical context of a low back injury.) Some individuals in a testing or therapeutic environment, then, appear to magnify the extent of the pain and disability as a result of non-physical factors. Behavioral, monetary, psychological and social factors forces are thought to also affect assessment of functional abilities, particularly in compensable cases. Mechanic and Matheson have written extensively about this phenomenon, known in the field as "symptom magnification."

As a result of abuses of compensation systems by defendants and petitioners alike, there is a demand for comprehensive functional assessment of claimants. Such evaluations can be used to assess validity of effort and to manage decisions regarding indemnity, treatment, an individual's ability to return to work. In compensation cases, it is necessary to objectively determine if a physical performance reflects a maximum physical effort. Performances that are not highly reproducible can not logically be classified as valid expressions of maximum physical capacity. Therefore, it has become beneficial to develop tools and methods which help clinicians objectively assess functional abilities, particularly lifting, carrying, pushing and pulling, because these are the most commonly performed material handling tasks.

Susan Isernhagen proposes the "kinesiophysical" approach to functional assessment. A standard protocol is administered to test subjects. Using this method of evaluation, therapists are reportedly able to identify valid efforts by noting the presence or absence of biomechanical failure during assessments of lifting, carrying, pushing and pulling capacities. Isernhagen proposes specific criteria which are said to indicate biomechanical breakdown and a valid effort. The application of the criteria, however, relies on the accuracy of the therapist's assessment of the physical performance, as opposed to extensive analysis of numerical data gathered during the test.

In the kinesiophysical protocol, termination points for various material handling tasks are determined by the therapist. Inter-tester variability in interpretation of performance is inevitable with such an approach. A subjective approach has the potential to expose a test subject to injury if a therapist misjudges physical capacity or effort. There is also the potential to incorrectly classify consistency of effort. The evaluation of symptom magnification does not play an important role in the approach advocated by Isernhagen.

Matheson and Blankenship propose the "psychophysical" method of functional assessment. These clinicians propose that any physical performance is affected by psychological as well as physical factors. The psychophysical approach is the most common type of protocol used to evaluate claimants in a compensation system.

Material handling activities in a psychophysical protocol are terminated when a test subject indicates an inability to safely perform at a higher workload or when, in the clinician's opinion, the safe biomechanical limits of the subject have been attained. Both of these termination points are subjective. In contradistinction to the kinesiophysical method, the method advocated by Matheson and Blankenship places a more emphasis on interpretation of raw data in order to add some objectivity to the assessment of validity of effort. Furthermore, Matheson and Blankenship place a greater value on incorporating cross-reference tests and observations into a protocol. Psychological and behavioral factors are also given more weight. For example, Waddell testing for non-physical pain responses in low back pain patients are routinely administered. (In landmark research, Gordon Waddell found a correlation between reports of pain arising from purposely-benign physical maneuvers and high scores on the scales for hypochondriasis, hysteria and depression on the Minnesota Multiphasic Personality Inventory.) Pain questionnaires intended to identify possible symptom magnification are also typically filled out by subjects in the psychophysical model.

Matheson and Blankenship also advocate the use of various multiple-trial isometric tests to assess consistency of effort. Inter-test variability between trials is analyzed with the coefficient of variation. It is noted, though, that the research on the coefficient of variation is divided as to the usefulness of this statistic in correctly classifying effort during isometric strength testing.

"Distraction testing" has become and acceptable method of assessing consistency of effort Waddell formally proposed the concept in the research previously cited. He insisted that for such testing to be valid, it must be "non-emotional, non-hurtful and non-surprising." Clinicians using the psychophysical method of evaluation frequently develop their own distraction tests for use during functional assessment, varying the protocols proposed by Matheson and Blankenship in accordance with their professional experience and judgement.

Basic testing equipment for assessing dynamic pushing and pulling capacities may involve the use of a cart upon which weight is place. There are four primary disadvantages to this approach. First, the amount of weight needed to create a high workload would involve placing large quantities of weight onto the cart. This is expensive, labor intensive and may even expose the clinician to injury. Second, the weight placed on the cart may be seen by the test subject and, therefore, has the potential to affect performance. Third, it is difficult to use a multiple trial test protocol to assess consistency of effort because of the visual cues available to the test subject. Fourth, incremental changes in workload can be effected, but may require removing or adding relatively large amounts of weight from the cart.

American Therapeutics, Macon, Georgia, markets "The Sled," which is an apparatus consisting of a platform mounted on two runners. Handles attached to the platform are grasped by the test subject. By generating a pushing or pulling force, the device can be maneuvered across a surface. The workload can be adjusted by adding weight to the platform. A force gauge is then connected to the invention and pushed or pulled by the clinician to determine the amount of pushing and pulling forces demonstrated by the test subject. Conducting multiple trials to assess consistency of effort is not practical with this device because the workload can bee seen by the subject. Small, incremental adjustment of the workload is difficult to accomplish. Test subjects may be reluctant to exert force against an object which has no wheels and, as a result, test results can be skewed. Furthermore, the condition of the floor (for example, the presence or absence of dust or the variability in the finish of a concrete floor) may affect the amount of force necessary to push the device from one location in the room to another. Lastly, this device is unsuitable for use on a hardwood floor because the runners of the sled can damage the surface over which it is maneuvered.

There are variety of testing devices capable of measuring isometric pushing and pulling capacities. Examples of such inventions are U.S. Pat. Nos. 4,972,711 and 5,275,045. This mode of testing maintains the test subject in a static body posture while the subject exerts force against a stationary object. However, there are few work-related activities which require the production of force which is exerted against an immovable object. Also, that is no direct relationship between isometric and dynamic physical abilities. Clinical research, as already noted, is divided on the usefulness of the coefficient of variation in assessing consistency of effort. With regard to its use as a rehabilitation mode, the benefits of isometric exercise are specific to the range of motion in which it is performed. Typically, this type of exercise is capable of increasing strength in a only narrow range of motion (approximately 10–15 degrees).

Numerous isokinetic devices have been invented. Such inventions are described in U.S. Pat. Nos. 3,465,592 and 4,907,797. U.S. Pat. No. 4,890,495 was specifically intended to measure isokinetic pushing and pulling abilities. Some isokinetic devices have the capability to measure pushing abilities while others test and measure only isolated joints and groups of muscles. These inventions apply an accommodating resistance to the test subject's efforts and, through mechanical and/or electronic means, the workload is maintained at a constant velocity. An isokinetic workload is a machine-generated, artificial workload significantly unlike the isoinertial workloads found in the workplace. Thus, there is no direct relationship between isokinetic physical capacities and the physical demands in the actual workplace. Furthermore, no standardized approaches to assessing consistency of effort for performances on this type of equipment has been developed. Instead, clinicians administering such tests usually assess consistency of effort by visual inspection of graphs which depict a performance. The variability, as seen on a graph, is said to reflect differences between repetitions. However, the apparent differences between repetitions is, to a large degree, affected by the scale on which each axis of the graph is displayed. Thus, visual analysis of graphs results in inter-tester variability in interpretation. Finally, U.S. Pat. No. 4,890495 limits the distance the subject can maneuver the testing apparatus to less than ten feet, far less than is often required on the job.

U.S. Pat. Nos. 4,337,050 and 4,473,226 and 4,475,408 are incorporated into a device now commercially known as the BTE Work Simulator. This invention has a number of uses, including one feature which measures isoinertial pushing and pulling capacities. The advantage to using this equipment is that the workload is unseen and, therefore, the test subject can not use visual inspection to estimate a workload. Workloads on the device are controlled by the clinician. Resistance is generated by an electromagnet which applies a workload to a pulley. A rope is wound round the pulley and connected to a bar which is held by the test subject. The test subject exerts a pushing or pulling force against the hand-held bar, moving the bar and rope away from the device. The workload applied by this equipment is isoinertial, the same type of resistance that would be encountered in the workplace. The Work Simulator, however, is limited in that the maximum distance the hand-held bar can be moved is less than ten feet. This is a significant disadvantage because pushing and pulling on the job may often require pushing and pulling force to be exerted over a longer distance.

U.S. Pat. No. 4,451,037 discloses a three-wheeled mobile pushing exerciser which uses a brake drum and brake shoe to apply an isoinertial workload. As described by the inventor, this device is intended to be used as a tool to increase the power of an athlete during a pushing activity. A computer monitors performance and provides information regarding velocities and distance traveled.

A dynamic physiological function testing apparatus and method, described in U.S. Pat. No. 5,142,910, utilizes an electromagnetic brake assembly to apply resistance to a cart intended for use in assessing isoinertial pushing and pulling capacities. This invention incorporates computerized components to measure other physical parameters, including velocity, direction of movement and hand grip strength. There is no adjustability in the handle height on this device. Furthermore, the use of an electromagnetic brake and computerized monitoring of activity add unnecessary cost to the invention. This device is not commercially available.

U.S. Pat. No. 3,501,142 (issued May 1, 1970 to Johannson) reveals a bicycle exerciser with clinically varying resistance. This invention utilized an approach "wherein the brake wheel consists of a flywheel and the brake member of a brake strip engaging said flywheel, said pedal crank being in driving connection with a ratchet wheel which in turn is in driving connection with a cam wheel, said pedal crank thereby rotating said ratchet wheel and said cam wheel when pedaled, and an engagement between said cam wheel and said brake strip on a side thereof which is opposite to the flywheel, so that the rotation of the cam wheel brings about a varying tension of the brake strip and thus a variation of the brake effect."

The braking specific described by Johansson is now in the public domain. It also differs substantially from the present apparatus in five significant ways. First, the braking system on the present invention is mounted to a cart which moves across a surface, while the Johansson invention was specifically described as being mounted upon a stationary bicycle. Second, the present system utilizes a tension spring, as opposed to Johansson's adjustable cam to regulate the workload. Third, on the present device it is possible to affix a plurality of brakes, whereas on the Johannson creation it was possible to affix only one such brake to the bicycle. Fourth, the methodology used in connection with the present device is intended, in part, to assess consistency of effort during a dynamic pushing or pulling task, whereas the Johansson invention was intended for use as an exercise device. Fifth, the present invention is useful in simultaneously exercising the upper extremities, trunk and lower extremities, as opposed to exercising the lower extremities only (as occurs while using a stationary bicycle).

There are several methods and devices on the market which are used to assess pushing and pulling capacities in the clinical setting. My own invention uses a concealed tension spring braking system to provide a constant isoinertial resistance as is encountered in the "real world." The primary method of controlling the workload occurs through the clinician's manipulation of the braking apparatus. Utilizing the concept of "distraction testing," marked or unmarked weights can be added to the platform of the cart as a confounding variable for test subjects who are trying to control the outcome of the test. Adding or removing 100 pounds of weight will only marginally change the amount of force required to move the cart (fewer than approximately 10 pounds). By using multiple trials, with different amounts of weight on the cart available for visual inspection by the test subject, and clinician-controlled application of resistance on the device, it is possible to objectively assess consistency of effort during a dynamic pushing and pulling assessment. Furthermore, the invention will be useful in exercising a muscle during a physical conditioning program. All pushing and pulling assessment devices and protocols heretofore known suffer from a number of disadvantages:

a) Protocols relying on a therapist's visual observation of a subject to assess validity of effort depend on the accuracy of a subjective interpretation of performance and, thus, are prone to possible excessive inter-tester variability in interpreting test results. Testing protocols of this kind are vulnerable to legal challenge. Furthermore, if a test subject's abilities are miscalculated by the therapist, injury or misclassification of effort can result.

b) Isometric devices measure a subject's capacity to generate pushing and pulling forces against an immovable object measure force which is not directly related to the ability to push or pull an object over a surface.

c) Isometric testing measures physical capacity of a specific and limited arc in the range of motion of any joint.

d) Isometric exercise benefits a specific and limited arc in the range of motion of any joint.

e) There is no clear consensus on the usefulness of the coefficient of variation in analyzing consistency of effort during isometric testing.

f) Isokinetic devices provide a descriptive account of the ability of a subject to push and pull an artificial workload that can be created only by devices in a clinical setting. However, there is no means by which an isokinetic performance can be used to predict the ability to push or pull the isoinertial workloads encountered in everyday life.

g) No standardized method of assessing validity of performance on isokinetic equipment has been developed.

h) In the evaluation of isoinertial pushing and pulling capacities, the BTE Work Simulator limits the distance over which pushing and pulling capacities can be tested.

i) The objectivity of a pushing and pulling assessment can be affected if workloads on any device, including a sled or a cart, are available for visual inspection by the test subject. As a result of this limitation, the objectivity of an assessment can be tainted.

j) Unless special adaptations are made to American Therapeutic's sled, that particular device can not be used in a gymnasium setting for training purposes because the runners of the sled may damage wooden floors.

k) The computerized equipment described in U.S. Pat. No. 5,142,910, U.S. Pat. No. 4,451,037 and U.S. Pat. Nos. 4,337,050 and 4,473,226 and 4,475,408 are significantly more expensive than the present invention. Furthermore, such complicated devices require significant training time for operators of such equipment to become proficient their use.

OBJECTS AND ADVANTAGES

The object of the invention is to provide a device to objectively assess dynamic pushing and pulling capacities. Specifically, the device and protocol are intended to provide objective information in evaluating consistency of effort between multiple trials of each activity. This goal is facilitated by applying workloads which can not be seen by the subject while simultaneously providing visible workloads as a distraction. This technique meets Gordon Waddell's criteria for "distraction testing" as cited previously.

Accordingly, several objects and advantages of the present invention are:

(a) to eliminate the subjective assessment of a clinician regarding the consistency of effort of a subject during a dynamic pushing and pulling assessment, replacing such assessment with a method and device which can be used to in a multiple trial protocol to objectively evaluate consistency of effort.

(b) to provide a device which tests a subject's pushing and pulling capacities in an isoinertial mode, such as is encountered in everyday life.

c) to provide a device which can test pushing and pulling capacities for a distance limited only by the floor space of a facility.

d) to provide a device which is capable of offering the subject approximately 150 pounds of resistance, sufficiently high to cause a training effect in an athletic population and higher than most on-the-job requirements for pushing and pulling.

(e) to provide a device which minimizes the visual cues that could affect the performance of a test subject.

(f) to provide a training device which can be used on a gymnasium floor without damaging the surface of the floor.

(g) to provide a device which is less costly and requires less training to become proficient in its use than computerized equipment.

Further objects and advantages are to provide a device which is compact in size and easy to maintain. Because of the high number of possible workloads that can be applied by using a combination of weights on the platform and simultaneously adjusting the tension on the braking system, it will be possible to test the same subject multiple times during the course of rehabilitation. Thus, repeated or prolonged experience in a compensation system will not interfere with obtaining objective assessment of consistency of effort. The device also has application for the physical rehabilitation or training a muscle to optimize physical performance. Other objects and advantages will become apparent from a consideration of the ensuing description and drawings.

DRAWINGS

A brief description of the drawings follows.

STRUCTURE

Figure 1:
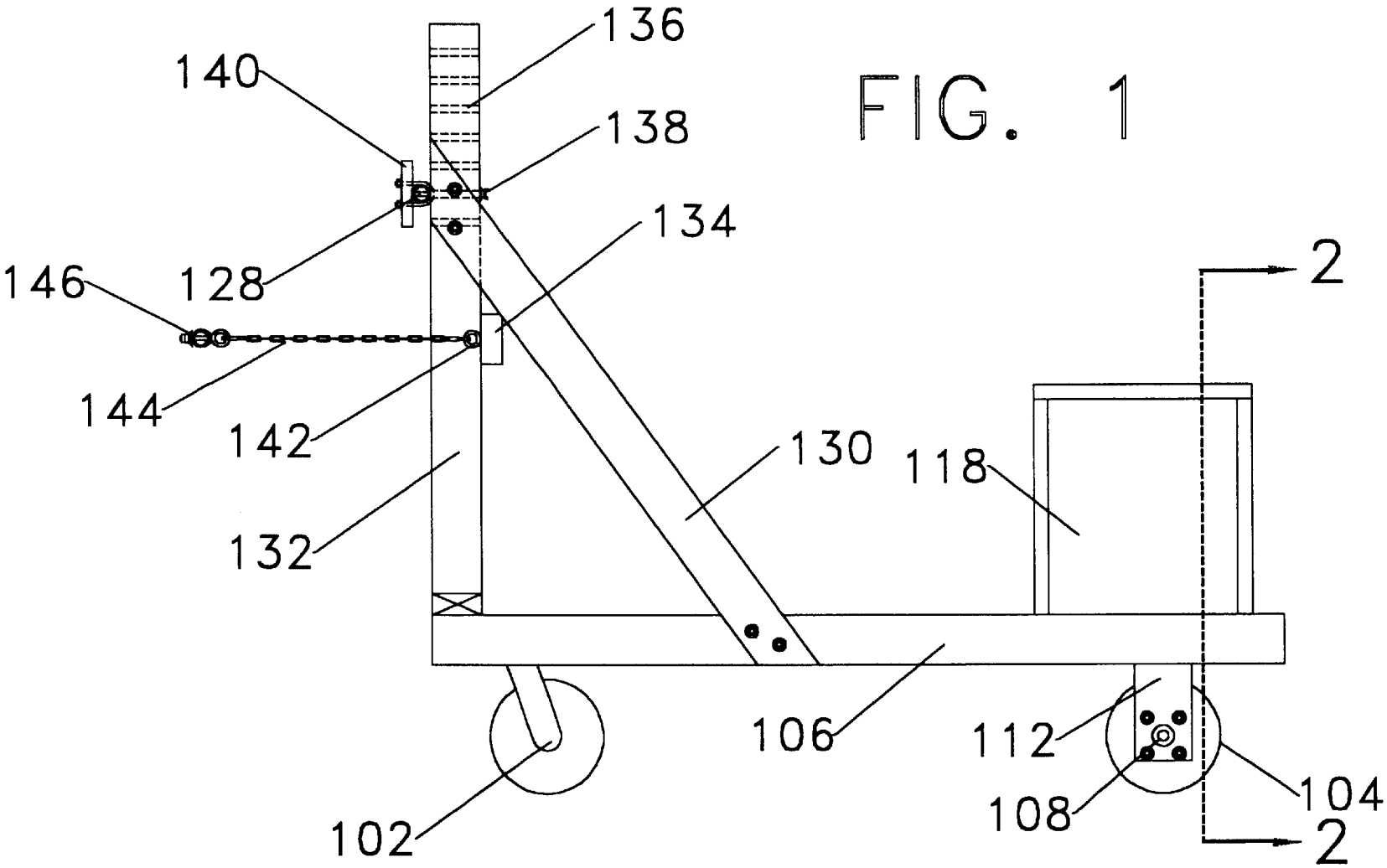
FIG. 1 is a side view of the apparatus.
Figure 2:
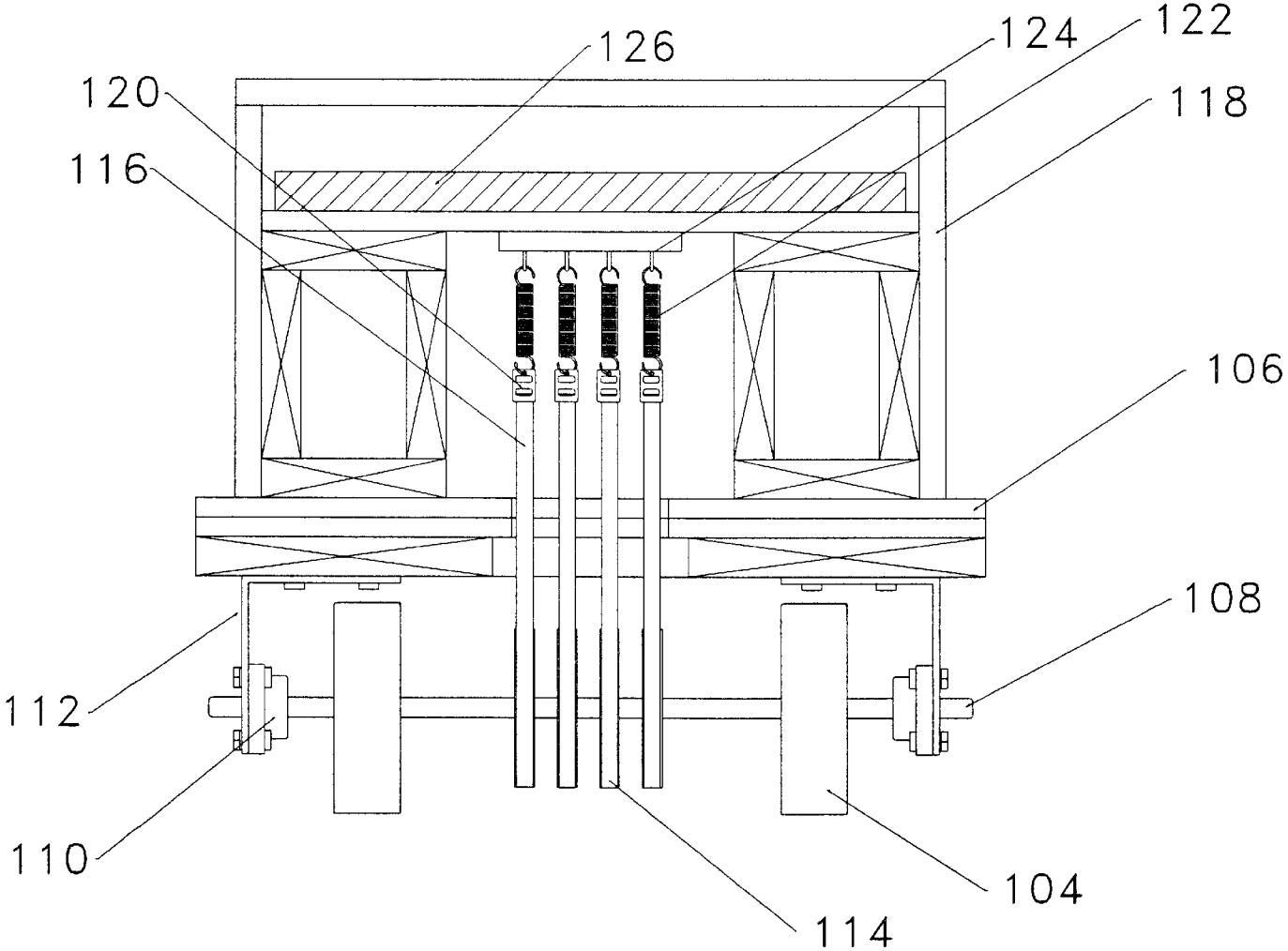
FIG. 2 depicts the braking system in a sectional view of the front of the apparatus.
Figure 3:
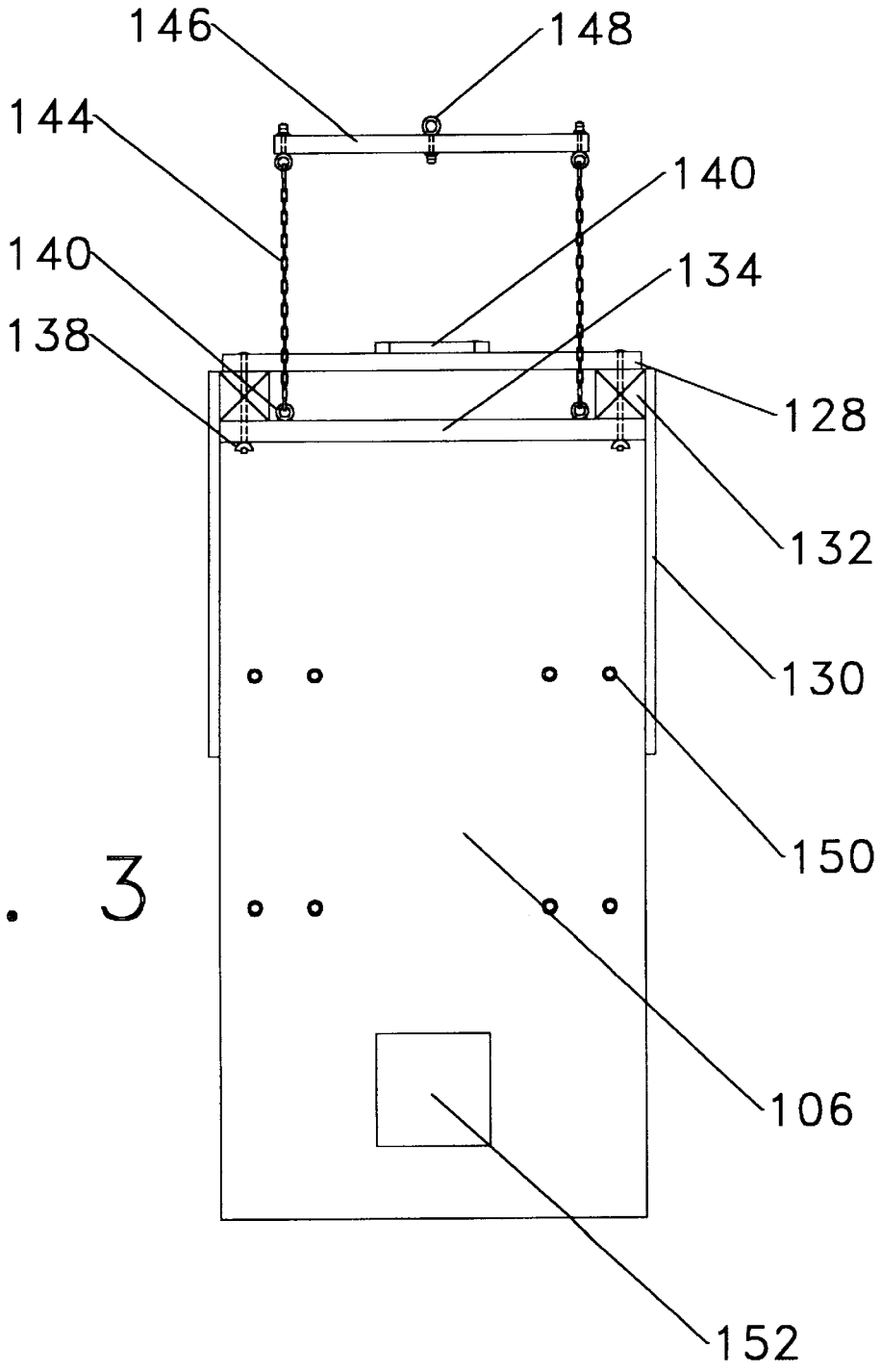
FIG. 3 is a top view of the device.
Figure 4:
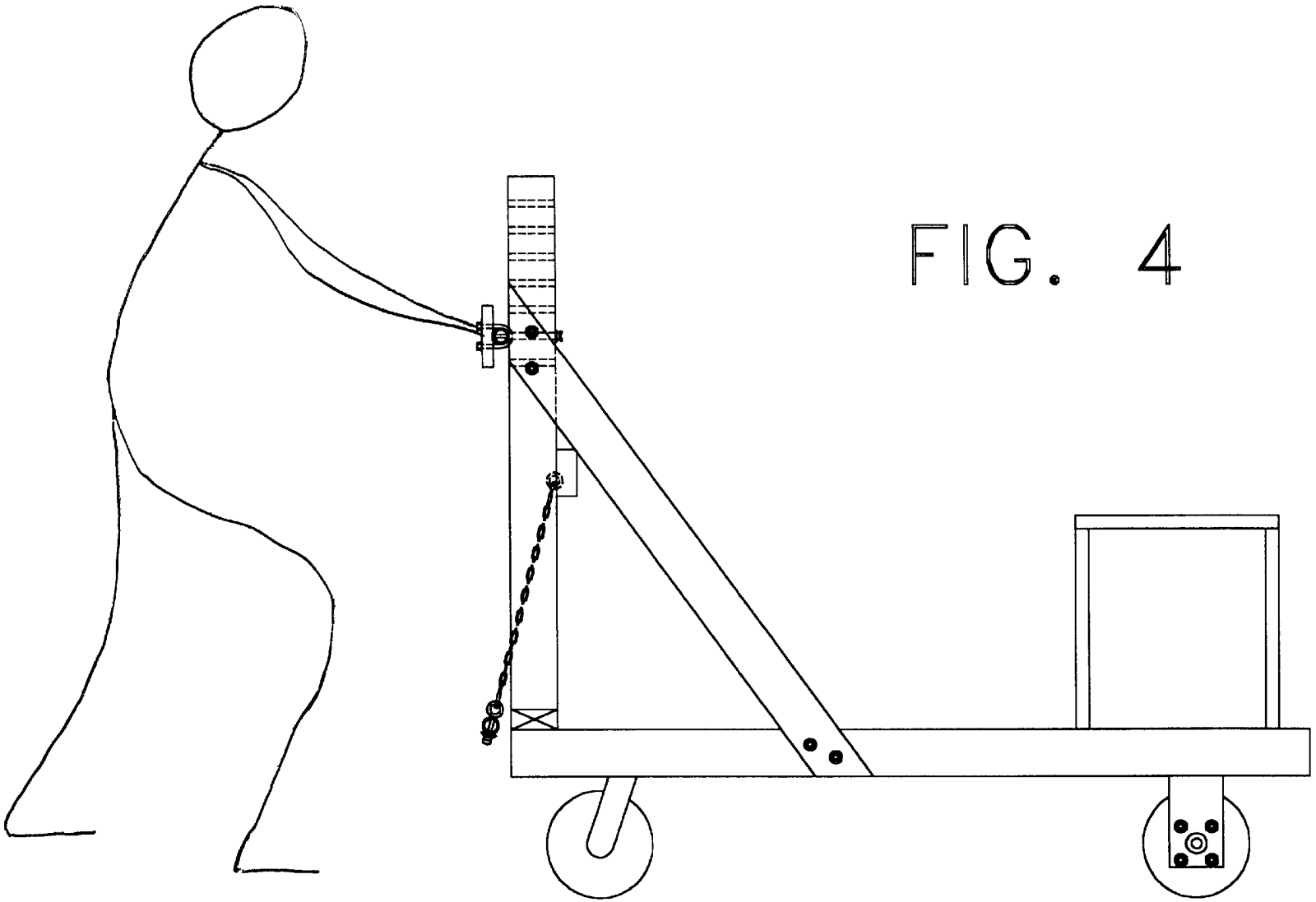
FIG. 4 depicts a subject pushing the invention.

Referring to FIGS. 1 and 2, a four-wheeled cart for exercising a muscle and testing consistency of effort during dynamic pushing and pulling capacity has rotatable casters 102 at the proximal end of the device. Rotatable wheels 104 are mounted beneath the distal end of a platform 106. Said wheels are affixed to an axle 108 in a static position, causing said axle and wheels to turn in unison. Bearing boxes 110 support the axle on which the wheels are affixed. Said bearing boxes are secured to a mounting bracket 112. Said mounting bracket is secured to the inferior surface of said platform. Pulleys 114 are affixed to the axle in a static position. Straps 116 are secured on one end to a braking system housing 118 and are in continuous contact with an arc on the perimeters of said pulleys. The other end of the strap is threaded through a slip buckle 120. (There is a hole 122 in the platform, shown in FIG. 3, through which said straps run.)

Continuing with a description of FIGS. 1 and 2, said slip buckle is suspended from a tension spring 122 which is secured to one end of an eye hook 124 which is in turn secured to said housing. Tension on the spring is adjusted by pulling the strap through the slip buckle and adjusting the amount of strap which is threaded through the slip buckle. A rectangular weight 126 is placed in said housing with its mass equally distributed above the center of the axle. Said weight supplies sufficient pressure on the axle and front wheels to allow the axle and front wheels of the cart to rotate freely when maximum tension is applied to the braking system and the device is pulled by a subject.

A handle 128 is supported by two diagonal, vertical and horizontal members, 130, 132 and 134, respectively. The lower of the two horizontal supports is affixed to the platform. The height of the handle is adjusted to match the anthropomorphic requirements of test subjects by using the several holes 136 drilled through the vertical supports. Wing nuts 138 facilitate the adjustment of the handle. A pushing force measurement plate 140 is mounted in the center of the handle. To measure pushing force generated by a test subject, a commercially available force gauge is placed against said plate by the clinician who subsequently exerts sufficient pushing force plate to cause the invention to move across a surface.

Pulling bar eye hooks 142 are secured to the superior horizontal member. A chain 144 connects the cart to said pulling bar 146. A pulling force measurement eye hook 148 is affixed to the center of the pulling bar. To measure pulling force generated by a test subject, a commercially available force gauge is attached to said eye hook 148 by the clinician who subsequently exerts sufficient force to cause the invention to move across a surface.

SUMMARY

In accordance with the present invention, a manually-propelled cart useful for testing isoinertial pushing and pulling capacity and for exercising a muscle, comprising a platform with rotatable wheels mounted thereunder, a stationary member mounted to the platform of the vehicle against which the test subject exerts force, a braking system and a testing protocol for assessing consistency of effort during dynamic pushing and pulling assessment.

BASIC OPERATION

The manner of using the pushing and pulling capacities testing device requires a test subject to exert a pushing or pulling force against the handle which is mounted to the platform of the device. A clinician adjusts resistance to the subject's effort by increasing or decreasing weight on the deck of the vehicle and increasing or decreasing the amount of tension on the straps of the braking system. The clinician can measure the pushing force generated by a test subject after any trial by holding a force gauge against the pushing force measurement plate and moving the vehicle across a surface. The pulling force generated by a test subject can be measured by the clinician by connecting a force gauge to the pulling force measurement eye hook and moving the vehicle across a surface.

TESTING METHODS

A standard testing protocol utilizing the psychophysical approach is suggested. In this protocol, a test is terminated if a subject indicates the inability to safely work at a higher workload or if, in the clinician's opinion, the body mechanics of the subject are unsafe. The subject is engaged in at least two trials to assess dynamic pushing and pulling capacities using the present invention. In the first trial, no weight is place on the platform. In the second trial, 100 pounds of weight is added to the platform. If more than two trials are desired by the clinician, more weight can be added to the platform of the cart with each successive trial.

The subject's resting heart rate while standing should be recorded before any activity. If considered clinically appropriate, a resting blood pressure could also be recorded. Prior to beginning any dynamic trial, the clinician adjusts the tension on the braking system until the subject indicates that the amount of force required to initiate movement of the cart would be rated at "7" or higher on a "0–10" scale. On this scale, "0" would indicate "no difficulty at all" and "10" would indicate "impossible to move." In some cases, it may prove necessary or advantageous to remove or add small amounts of weight to the platform of the cart as well as adjust the tension on the braking system. The subject is then instructed to push the cart as far as possible, up to a maximum of 50 feet. The subject must take at least three steps for any trial to be considered "successful." The subject's heart rate should be allowed to return to a resting rate before each trial. The measurement of blood pressure may also prove useful in ensuring a resting level has been achieved before beginning any trial.

The time to complete each trial and the distance the device is moved for each trial is recorded by the clinician. Following each trial, the peak force exerted during the activity and the average amount of force required to sustain movement of the present invention can be determined by using a commercially available force gauge. Total work output for each trial is calculated by multiplying the average force measured on the force gauge by the distance traveled during the trial. Average power can be calculated by dividing total work output by the number of seconds required to complete the trial.

Consistency of effort can be assessed by comparing the data produced during each trial. Physical parameters that could be examined include peak forces to initiate movement of the workload, average force to sustain movement of the cart, total work output and power. Excessive variations in inter-test comparisons would indicate inconsistency of effort. If isometric testing is also conducted, comparisons between average and peak isometric and dynamic forces can be made as well. (The generation of more dynamic than isometric force is a contradiction of the laws of physics and could be an indication of inconsistency during a test.)

CONCLUSIONS, RAMIFICATIONS AND SCOPE

Accordingly, the reader will see that the subject-propelled vehicle can be used to test consistency of effort during an assessment of pushing and pulling capacities. In addition, the invention will have use as a therapeutic device to exercise a muscle. Furthermore, the invention has the additional advantages in that:

(a) the high number of permutations with regard to workloads that can be applied with the braking system make it difficult for a test subject to guess how much force is required to push or pull the invention. This feature will enhance the ability of a clinician to objectively identify inconsistencies in performance by conducting multiple trials and analyzing differences in physical performance parameters between the trials.

(b) the high number of permutations with regard to workloads that can be applied will make it possible for the same subject to be re-tested on the device without the previous exposure to the invention affecting the objectivity of the assessment.

c) the cost of this invention will be substantially less than inventions which utilize electronic means to measure and apply.

d) the device is easy to use and will take a minimal amount of training time for a clinician to become proficient in its use.

e) there is no need to periodically re-calibrate the device because the workloads are determined by basic and unchanging laws of physics.

f) the device takes up a minimal amount of space and can be easily stored.

g) the device has few moving parts and will be easy to maintain in good working order.

i) the device offers isoinertial resistance, such as is most typically encountered in the workplace.

j) testing and exercise on the device can be performed over distances comparable to those found in the workplace, as opposed to having limitations that are related to the design of the invention.

Although the description above contains many specificities, these should not be construed as limiting the scope of the invention, but as merely providing illustrations of some of the presently preferred embodiments of this invention. The device could be made of steel, wood, synthetic, or composite material. The invention could be made with three wheels or more than four wheels. Said wheels could be of a dimension other than those indicated in the illustrations. The dimensions of the cart could vary from those presented in the description above. The supports beneath the deck could be of other dimensions or eliminated, depending on the amount of weight the vehicle would be required to support. In another embodiment, the tension springs on the braking system could be of sizes or strengths other than those in the present invention. The casters shown in the drawings could be replaced with wheels affixed to an axle. The weight above the axle could be eliminated or increased, according to the desired magnitude of the maximum workload applied by the braking system. Provision could be made to facilitate placing variable amounts of weight above the axle. The number of pulleys on the braking system could exceed, or be fewer than, the number of pulleys in the preferred embodiment. The pulleys could be larger or smaller than those depicted in the drawings. The hand-held bar used for pulling the device could be eliminated. A harness or belt could be worn by the user and connected by a wire, cable, strap, rope or chain to the deck of the vehicle to allow the user to exert a pulling force for testing purposes or to exercise a muscle.

REFERENCES

Agre J, Magness J, Hull S, Wright K, Baxter T, Patterson R, et. al.: Strength Testing with a Portable Dynamometer; Reliability for Upper and Lower Extremities. *Archives of Physical Medicine and Research*, 68:454–458, 1988.

Mital A, Karwowski W, Mazoua A, Orsarh E: Prediction of Maximum Acceptable Weight of Lift in the Horizontal and Vertical Planes Using Simulated Job Dynamic Strengths, *American Industrial Hygiene Association Journal*, 47(5):288–292, 288–291, 1986.

Battie M, Bigos S, Fisher L, Hansson T, Jones M, Wortley M: Isometric Lifting Strength as a Predictor of Low Back Pain, *Spine*, 14:851–856, 1989.

Beaton D, O'Driscoll S, Richards R: Grip Strength Testing Using the BTE Work Simulator and the Jamar Dynamometer: A Comparative Study. *Journal of Hand Surgery*, 20A(2):293–298, March, 1995

Blankenship K: *Industrial Rehabilitation: A Seminar Syllabus*, American Therapeutics, Inc., 1990.

Bohannon R: Differentiation of Maximal from Submaximal Static Elbow Flexor Efforts by Measurement Variability. *American Journal of Physical Medicine*, 66(5):213–217, 1987

Fairfax A, Balnave R, Adams R: Variability of Grip Strength During Isometric Contraction. *Ergonomics*, 38(9):1819–1830, 1995

Fromoyer J, Cats-Baril W. Predictors of Low Back Pain Disability. Clinical *Orthopeadics*, 221:89–98.

Fromoyer J, Pope M, Clements J, Wilder D, MacPherson B, Ashikaga T: Risk Factors in Low-Back Pain: An Epidemiological Study, *Journal of Bone and Joint Surgery*, 8(8): 14–24, 1991.

Harber P, SooKoo K: Static Ergonomic Strength Testing in Evaluation of Occupational Back Pain. *Journal of Occupational Medicine*, 26:877–884, 1984

Hirsch G, Beach G, Cooke C, Menard M, Lock S: Relationship Between Performance on Lumbar Dynamometry and Waddell Score in a Population with Low Back Pain. *Spine*, 16(9):1039–1043, 1991

Isernhagen S, *Comprehensive Guide to Work Injury Management*, Aspen Publishing, Gaithersburg, Md., 1995.

Klenerman L, Slade P, Stanley M, Pennie B, Reilly J, Atchison L, Troup J, Rose M: The Prediction of Chronicity in Patients With an Acute Attack of Low Back Pain in General Practice Setting. *Spine*, 20(4):478–484, 1995.

Matheson L. How Do You Know He Tried His Best? *Industrial Rehabilitation Quarterly*, 1:82–82, 1988.

Matheson L. *Symptom Magnification Syndrome*, Presented in a symposium by Roy Matheson and Associates, 1991.

Matheson L. *Work Capacity Evaluation: Systematic Approach to Industrial Rehabilitation*. Employment and Rehabilitation Institute of California, Anaheim, Calif., 1986.

Mechanic D: The Concept of Illness Behavior. *Journal of Chronic Disorders*, 15: 182–184, 1967.

Menard M, Cooke C, Locke S, Beach C Butler T: Pattern of Performance in Low Back Pain During a Comprehensive Motor Performance Evaluation. *Spine*, 19(12):1359–1366, 1994.

Robinson M, Macmillan M, O'Connor P, Fuller a, Cassisi J. Reproducibility of Maximal Versus Submaximal Efforts in and Isometric Lumbar Extension Task. *Journal of Spinal Disorders*, 4:444–448, 1991.

Simonsen, J: Coefficient of Variation as a Measure of Sincere Effort. *Archives of Physical Medicine and Rehabilitation*, 76:516–520, 1995.

Snook S: The Costs of Back Pain in Industry, *Spine*, 2:1–5, 1987.

Spengler D, Bigos S. Martin N, et. al.: Back Injuries in Industry, *Spine*, 11:241–245, 1986.

Spengler D, Szpalski M: Newer Assessment Approaches for the Patient with Low Back Pain. *Contemporary Orthopaedics*, 21(4): October 1990

Waddell G: A New Clinical Model for the Treatment of Low-Back Pain, *Spine*, 12:632–644, 1987.

Waddell G, Main C, Morris E, Paola M, Gray I: Chronic Low-Back Pain, Psychologic Distress, and Illness Behavior. *Spine*, 9:209–213, 1984.

Waddell G, McCulloch J, Kummel E, Venner R: Nonorganic Physical Signs in Low-Back Pain. *Spine*, 5(2), 1980.

Thus, the scope of the invention should be determined by the appended claims and their legal equivalents, rather than by the examples given. I claim:

1. A subject-propelled apparatus, comprising:

A) a platform having rotatable wheels mounted thereunder for enabling a cart to roll along a surface, B) a handle mounted upon said platform, against which the test subject exerts a pushing or pulling force, C) a braking apparatus consisting of:

a) two or more wheels mounted beneath the vehicle and affixed to an axle in a static position, causing said wheels to rotate in unison with the axle when force sufficient to overcome the inertia of the apparatus is exerted against said handle, b) a pulley affixed to said axle in a static position, rotating in unison with the axle, c) a strap held in contact with an arc on the perimeter of said pulley, with one end of said strap affixed to a supporting frame and the opposite end threaded through a slip buckle, d) a tension spring connected on one end to said slip buckle and the opposite end of said tension spring affixed to said supporting frame, whereby a clinician applies a workload to the apparatus by adjusting tension on the braking system and a subject exerts a pushing or pulling force against the handle, thereby transmitting force through the apparatus in opposition to the braking system, causing the device to move across a surface.

* * * * *